United States Patent [19]

Poschet et al.

[11] Patent Number: 4,853,506

[45] Date of Patent: Aug. 1, 1989

[54] PRESSURE ACTUATED SNAP SWITCH

[75] Inventors: Klaus Poschet, Baldham, Fed. Rep. of Germany; Willy Bänteli, Schaffhausen, Switzerland

[73] Assignee: Bircher, AG., Beringen, Switzerland

[21] Appl. No.: 68,080

[22] Filed: Jun. 30, 1987

[30] Foreign Application Priority Data

Jul. 10, 1986 [DE] Fed. Rep. of Germany ..... 3623200

[51] Int. Cl.[4] ..... H01H 5/06

[52] U.S. Cl. ..... 200/463; 200/286; 200/465

[58] Field of Search ..... 200/67 B, 251, 286, 200/332, 335, 463, 465

[56] References Cited

U.S. PATENT DOCUMENTS

| | | | |
|---|---|---|---|
| 1,723,635 | 8/1929 | Tannehill | 200/286 X |
| 2,193,126 | 3/1940 | Furnas | 200/462 X |
| 3,566,058 | 2/1971 | Elliott | 200/463 |

*Primary Examiner*—Renee S. Luebke
*Attorney, Agent, or Firm*—Helfgott & Karas

[57] ABSTRACT

First and second contact bars are spaced apart in fixed positions. A pressure responsive ram has first and second positions of penetration into a casing which contains the bars and other elements. A bolt is disposed between the ram and a first element which is pivotable about the second bar between a first position and a second position. A second elemtn is coupled to the first element. When the ram is in its first position, the bolt places the first element in the first position causing the second element to establish a current carrying path between the bars. When the ram is in its second position, the bolt places the first element in the second position, causing the second element to break the current path. A device disposed between the belt and the ram exerts a biasing pressure on one end of the ram which maintains the ram in its first position. When a larger pressure is exerted on the other end of the ram, the ram is moved into the second position.

6 Claims, 1 Drawing Sheet

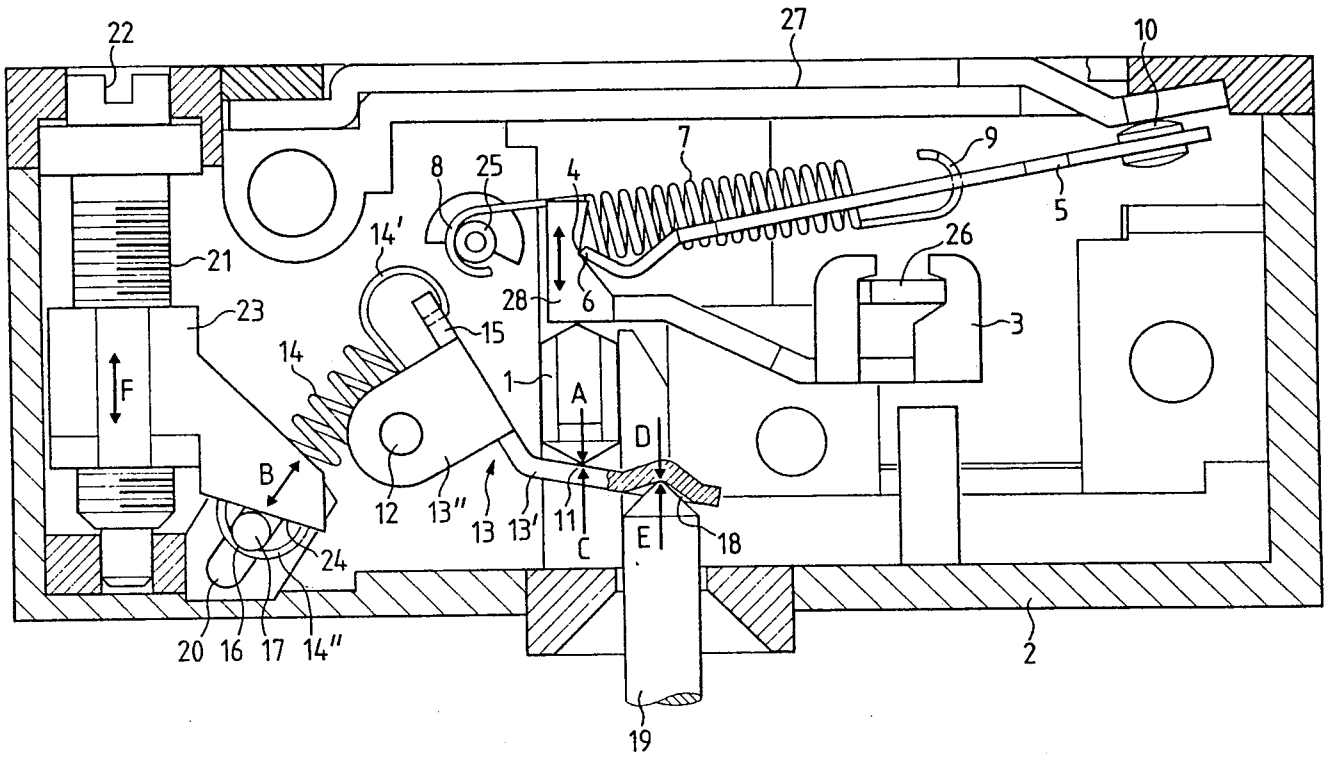
10
5
9
26
3
2
27
7
4
6
28
25
8
15
14'
1
A
D
E
18
19
11
C
13'
13
13''
12
14
B
24
14''
17
16
20
23
21
22
F

PRESSURE ACTUATED SNAP SWITCH

BACKGROUND OF THE INVENTION

The present invention relates to a pressure-actuated snap switch with a casing, wherein a connecting link is supported by spring tension in a bearing. The switching operation is under control of a bolt guided in the switch casing. The bolt itself is controlled by a ram passing through the casing wall and bearing upon the longer lever arm of a lever pivotably mounted in the casing.

In order to initiate a switching action in such a snap switch, it is necessary for a force acting upon the operating ram, to be sufficiently high to force a snap spring over the dead-center position and, optionally, to tension an additional restoring spring. The force which has to be applied is several times greater than that producing the contact pressure. Thus, if a minimum contact pressure is required, this presupposes the action of a correspondingly higher force on the operating ram. In applications where only limited forces are available for operating the switch, as for example when the switch is to be tripped by shock waves in the medium surrounding it, the attainable contact pressure is normally limited.

It has been known to use a compression spring to actuate the ram by pretensioning the spring to such an extent that the force or tension stored therein is lower than that necessary for initiating the switching operation. Thus, in this embodiment only a small additional force acting on the operating ram is necessary for initiating the switching operation. In order to be able to better adapt such a snap switch to the operating conditions, it has also been proposed in connection with this embodiment to operate the operating ram via a lever and not directly. An auxilliary ram acts upon the lever, and a pretensioned opposing spring adjustable counter to the operation of the auxiliary ram acts on the lever. This embodiment suffers from the disadvantage that there are two springs, which partly reciprocally compensate one another and consequently make the construction more complicated and expensive. Moreover, during operation, the length of the opposing spring and consequently the force stored therein is significantly changed.

SUMMARY OF THE INVENTION

It is an object of the present invention to further develop a snap switch of the aforementioned type so that only one spring is required, whose force value only changes insignificantly during operation.

In accordance with the principles of the invention, a snap switch mounted in a casing is provided with first and second contact bars which are spaced apart in fixed positions. A first electrically conductive element is pivotable about the second bar between first and second positions. A second electrically conductive element is mechanically and electrically coupled to the first means. The second element, when the first element is in the first position, is moved to a corresponding first position at which a current carrying path is established between the first and second bars, and when the first element is in the second position, is moved to a corresponding second position at which said path is broken.

A pressure responsive ram has one end extending into the casing, which is disposed adjacent but spaced from said first element and has an opposite end disposed outside the casing. The one end of the ram has first and second positions of penetration into the casing, the depth of penetration being greater in the second position then that in the first position. The first element is in its first position when the one end of the ram is in the first penetration position and is in its second position when the one end of the ram is in the second penetration position.

A bolt is disposed between the one end of the ram and the first element to place the first element in the first position when the one end of the ram is in the first penetration position and to place the first element in the second position when the one end of the ram is in the second position.

A biasing device is disposed between the bolt and the one end of the ram to exert a biasing pressure on the one end of the ram which in the absence of a larger and oppositely directed pressure on the other end of the ram maintains the one end of the ram in the first penetration position whereby the current carrying path is established, said path being opened when said larger and oppositely directed pressure is applied to the other end of the ram and causes the one end of the ram to be moved into the second position of penetration.

A tension spring may be provided which is pretensioned against the casing, which acts under a small acute angle on a lever arm whereby the component of the force stored in the tension spring acting on the lever is lower than the force necessary to initiate the switching operation. Only one tension spring is required for starting the switching operation. As a result of its geometrical arrangement with respect to the lever, the reduction of its force value is kept small. This permits switching with constant pressures of the medium. The foregoing as well as additional objects and advantages of the invention will either be explained or will become apparent to those skilled in the art when this specification is read in conjunction with the brief description of the drawings and the detailed description of preferred embodiments which follow.

BRIEF DESCRIPTION OF THE DRAWING

The accompanying FIGURE illustrates a preferred embodiment of the invention.

DETAILED DESCRIPTION OF THE PREFERRED EMBODIMENTS

The FIGURE shows the switch in one position wherein a current path is established between fixed contact bars 27 and 26 via a contact 10 provided on a link 5, and a bow shaped member 3. The member 3 which conducts current together with a bearing 28 is pivotable about bar 26 in a casing 2 under the control of a bolt 1. Link 5 has knife edges 6 and is movably mounted in a bearing 28 having a knife-edge support 4. A snap spring 7 is movably fixed at its one end 8 to a bolt 25 supported in casing 2 and at its other end 9 to the connecting link 5. Thus, snap spring 7 holds together under pretension the snap-action system which comprises bow-shaped member 3, bearing 28 and connecting link 5. This pretension builds up a first contact pressure, for example of x.cN at a contact point of contact 10 of the contact bar 27. The first contact pressure of x.cN leads to establishment of a second force of 8x.cN in the direction of arrow A at a support point 11 of bolt 1. In turn, this force requires an operating force of 8x.cN in the direction of arrow C.

In order to reduce the operating force in the direction of arrow C from 8x.cN to a lower amount, as for example 2x.cN, a two-arm bent lever 13 movably mounted on a fulcrum 12 in casing 2 is applied in support point 11. A tension spring 14, has one end 14' applied to an angle tip 15 of the two-arm lever 13 and the other end 14'' applied to an application point 16 on a bearing bolt 17 displaceable in the direction of arrow B and reduces the operating force in the direction of arrow C. As a result of the leverage of lever arms 13' and 13'', a force in the direction of arrow E is obtained on a bead 18 made in the longer lever arm 13'. This force can be overcome by the sought operating force from the outside via a ram 19 with a force of 2x.cN applied in the direction of arrow E. The direction of movement of ram 19 can coincide with or differ from that of bolt 1.

In order to maintain variable the necessary operating pressures via ram 19 on bead 18 in the direction of arrow E, the adjustment of the pretension of tension spring 14 can be adjusted. This is brought about by displacing bearing bolt 17 in a guide groove 20 running in the direction of arrow B.

A set screw 21 can be rotated as for example by a screwdriver engaging a screw slot 22. An adjustment part 23 screwed on set screw 21 can be moved by the latter in the direction of arrow F. Bearing bolt 17 engaging on the edge of adjustment part 23 consequently modifies the pretension of tension spring 14. Edge 24 appropriately engages bolt 17 under an angle differing from 90° to the direction of guide groove 20, so that bearing bolt 17 rests in clearance-free manner on one side of guide groove 20.

When the force acting on ram 19 along direction E exceeds the force acting in direction D, the bolt 1 is moved against the bearing 28, causing member 3 to pivot about bar 26. This action causes link 5 to swing contact 10 out of engagement with contact bar 27 to interrupt the current path between the contact bars 26 and 27.

While the invention has been described with detailed reference to the drawing, it will be obvious to those skilled in the art that many modifications and changes can be made within the scope and sphere of the invention as defined in the claims which follow.

We claim:

1. A snap switch comprising:

a casing;

first and second contact bars which are spaced apart in fixed positions;

a first electrically conductive element pivotable about the second bar between first and second positions;

a second electrically conductive element mechanically and electrically coupled to said first element, said second element, when the first element is in the first position, being moved to a corresponding first position at which a current carrying path is established between the first and second contact bars, said second element, when the first element is in the second position being moved to a corresponding second position at which said path is broken, said casing accommodating said first and second contact bars and said first and second elements;

a pressure responsive ram having one end extending into the casing and spaced from said first element and an opposite end disposed outside the casing, said one end of the ram having first and second positions of penetration into the casing which differ in depth, the depth of penetration being greater in the second position of penetration than in the first position, said first element being in a first position when the one ram end is in the first penetration position and being in its second position when the one ram end is in the second penetration position;

a bolt also accommodated in said casing and having one end engaging the first element and an opposite end adjacent but offset from the ram, said bolt placing the first element in the first position when the one ram end is in the first penetration position and placing the first element in the second position when the one ram end is in the second position; and biasing-pressure exerting means disposed in said casing and exerting pressure onto said bolt, the path being opened when pressure is applied to the opposite end of the ram and causes the one end of the ram to be moved into the second position of penetration;

the biasing-pressure exerting means including a bent lever having two arms of unequal length, one of said arms being engageable with said one end of the ram at one side thereof and with said opposite end of said bolt at an opposite side thereof and another of said arms having a fulcrum mounted in said casing so that said lever is pivotable about a point spaced from said first and second elements, a tension spring having one end connected to said one of said arms, a bearing bolt supporting another end of said tension spring, said casing having a guide groove receiving said bearing bolt and guiding the bolt, and adjusting means for displacing said bearing bolt in said guide groove and thereby adjusting an action point of said tension spring acting on said lever, said guide groove extending substantially along an axis of said tension spring, said adjusting means including a set screw inclined with respect to the axis of said tension spring.

2. The switch of claim 1, wherein the second element includes a snap spring.

3. The switch of claim 2, wherein the first element includes a bearing.

4. The switch of claim 3, wherein said one end of said bolt engages said bearing.

5. The switch of claim 1, wherein said adjusting means further includes an adjusting part screwed on said set screw and movable thereby, said adjusting part having an edge engaging said bearing bolt to displace the bolt.

6. The switch of claim 5, wherein said edge engages said bearing bolt at an angle differing from 90° to a direction of said guide groove.

* * * * *